United States Patent [19]

Scott

[11] Patent Number: 4,699,411

[45] Date of Patent: Oct. 13, 1987

[54] REFUSE COLLECTION DEVICE

[76] Inventor: Menzy Scott, 382 Valley Scent Ave., Scotch Plains, N.J. 07076

[21] Appl. No.: 3,646

[22] Filed: Jan. 15, 1987

[51] Int. Cl.[4] ..... B08B 1/00

[52] U.S. Cl. ..... 294/61; 294/19.1; 294/50.9

[58] Field of Search ..... 294/61, 19.1, 22, 23, 294/50.6, 50.8, 50.9, 99.1

[56] References Cited

U.S. PATENT DOCUMENTS

| | | | |
|---|---|---|---|
| 2,905,498 | 9/1959 | Lunde . | |
| 2,989,334 | 6/1961 | Browne . | |
| 3,105,715 | 10/1963 | Happ . | |
| 3,183,031 | 5/1965 | Haberstick . | |
| 3,873,143 | 3/1975 | Foust . | |
| 3,885,824 | 5/1975 | Hulst . | |
| 4,141,579 | 2/1979 | Moss | 294/61 |
| 4,192,539 | 3/1980 | Broyles et al. | 294/19.1 |
| 4,359,240 | 11/1982 | Woeber . | |
| 4,630,366 | 12/1986 | Fry | 294/50.9 |

*Primary Examiner*—James B. Marbert

*Attorney, Agent, or Firm*—R. Martin Oliveras

[57] ABSTRACT

A refuse collection device comprises: a cylindrical elongated tubular structure including a proximal handle end and a distal functional end; a transverse support structure penetrating such elongated tubular structure distal functional end for fixedly supporting a further distal pointed rod structure and for rotatably supporting a further distal divided semi-circular spring structure; and a slidable structure being longitudinally slidable on such elongated tubular structure and including top and bottom longitudinally directed grooves or slits for accommodating such transverse support structure during the longitudinal motion of such slidable structure; such semi-circular spring structure including a proximal quarter-circular substantially rigid member having its proximal end being rotatably attached to such transverse support structure, a distal quarter-circular spring member having its proximal end being rotatably attached to such proximal quarter-circular substantially rigid member distal end, and transverse wheel members being rotatably attached to such distal quarter-circular spring member distal end.

4 Claims, 11 Drawing Figures

REFUSE COLLECTION DEVICE

FIELD OF THE PRESENT INVENTION

This invention relates to refuse collection devices and in particular to such devices which include multiple configurations for picking up several forms of refuse off different type surfaces.

DISCUSSION OF THE PRIOR ART

The prior art reveals several patents disclosing so-called refuse collection devices such as:

a. Lunde U.S. Pat. No. 2,905,498 entitled "Picking And Grasping Device" discloses a device comprising a pair of elongated and opposed jaws, movement producing means, an object engaging portion, a strip, an object engaging surface, a plurality of teeth, and object engaging tines;

b. Browne U.S. Pat. No. 2,989,334 entitled "Bottle And Can Lifter" discloses a lifter comprising an elongated tubular structure, a stationary jaw, a bellcrank structure, a leg, an elongated rod, a finger grip, bearing means, and a handle assembly;

c. Happ U.S. Pat. No. 3,105,715 entitled "Pick-Up Device" discloses a device comprising an elongated shank, a handle, a spicate impaler, guide means, a pull rod, a finger, spring means, and coupling means;

d. Haberstick U.S. Pat. No. 3,183,031 entitled "Paper And Rubbish Pick-Up" discloses a device comprising a metal tubing, an element, an extensible coil spring, an impaling rod, a handle, and a bell crank lever;

e. Foust U.S. Pat. No. 3,873,143 entitled Device For Picking Up Litter" discloses a device comprising an elongated tubular body, an elongated shaft, compressible spring means, a first latch element, a second latch element, a manually operated element, and operative means;

f. Hulst U.S. Pat. No. 3,885,824 entitled "Pickup Device" discloses a device comprising an elongated channel shaped body, a handle, a pad, a fixed finger, a pair of nuts, a loop, a threaded bolt, a pivotable finger, an elongated rod, a sleeve, a compression spring, and trigger means; and g. Woeber U.S. Pat. No. 4,359,240 entitled Device For Small Cylindrical And For Penetratable Objects" discloses a device comprising a support shaft, a pair of pivotally connected arcuate jaw elements, gap width adjusting means, tension coil spring means, and large diameter rollers.

It therefore appears that such complex, remotely activated prior art devices fail to disclose the refuse collection device of the present invention.

Objects of the present invention are therefore to:

a. provide a refuse collection device for gripping an object and restricting movement and slippage thereof so as to prevent losing hold of such object;

b. provide such device which conforms to the general shape or contour of an object in order to engage a desired area thereof; and c. provide such device for picking up bottles, cans, paper, cardboard, or similar rubbish.

SUMMARY AND FEATURES OF THE PRESENT INVENTION

Features of the present invention are therefore that:

a. a refuse collection device comprises: a cylindrical elongated tubular structure including a proximal handle end and a distal functional end; a transverse support structure penetrating such elongated tubular structure distal functional end for fixedly supporting a further distal pointed rod structure and for rotatably supporting a further distal divided semi-circular spring structure; and a slidable structure being longitudinally slidable on such elongated tubular structure and including top and bottom longitudinally directed grooves or slits for accommodating such transverse support structure during the longitudinal motion of such slidable structure; such semi-circular spring structure including a proximal quarter-circular substantially rigid member having its proximal end being rotatably attached to such transverse support structure, a distal quarter-circular spring member having its proximal end being rotatably attached to such proximal quarter-circular substantially rigid member distal end, and transverse wheel members being rotatably attached to such distal quarter-circular spring member distal end;

b. in a first configuration: such semi-circular spring structure is in line with such elongated tubular structure longitudinal axis and distal to such transverse support structure; and such slidable structure is in its most proximal position along such elongated tubular structure thereby exposing such proximal rod structure, so that the refuse collection device may be used for picking up paper, bags, cardboard, and other flat debris on hard surfaces;

c. in a second configuration: such proximal quarter-circular substantially rigid member is rotated rearwardly relative to such transverse support structure and is located at an acute angle relative to such elongated tubular structure longitudinal axis; such distal quarter-circular spring member is rotated forwardly relative to such proximal quarter-circular substantially rigid member and is located at an acute angle relative to such proximal quarter-circular substantially rigid member; such wheel members are located substantially laterally to such transverse support structure; and such slidable structure is in its most proximal position along such elongated tubular structure thereby exposing such pointed rod structure, so that the refuse collection device may be used for picking up paper, bags, cardboard, and other penetrable debris on soft surfaces;

d. in a third configuration: such proximal quarter-circular substantially rigid member is in line with such elongated tubular structure longitudinal axis and distal to such transverse support structure; such distal quarter-circular spring member is rotated rearwardly relative to such proximal quarter-circular substantially rigid member and is located at an acute angle relative to such proximal quarter-circular substantially rigid member; such wheel members are located substantially laterally to such transverse support structure; and such slidable member is in its most proximal position along such elongated tubular structure thereby exposing such pointed rod structure, so that the refuse collection device may be used for picking up bottles, cans, and other circular or cylindrical debris on almost any type surface.

Advantages of the present invention are therefore that:

a. it is of simple, durable, and inexpensive construction and is easy to operate;

b. the bottles or cans may be picked up without the operator bending over;

c. it does not require remote activation by the operator to effect the picking up of bottles, cans, or the like; and d. it does not require active distal movable jaw structures to be activated by the operator to effect the picking up of bottles, cans, or the like.

DESCRIPTION OF THE DRAWING

The above and other objects, features, and advantages of the present invention will be better appreciated from a reading of the following detailed description in conjunction with the drawing in which.

DETAILED DESCRIPTION OF THE PRESENT INVENTION

Figure 1:
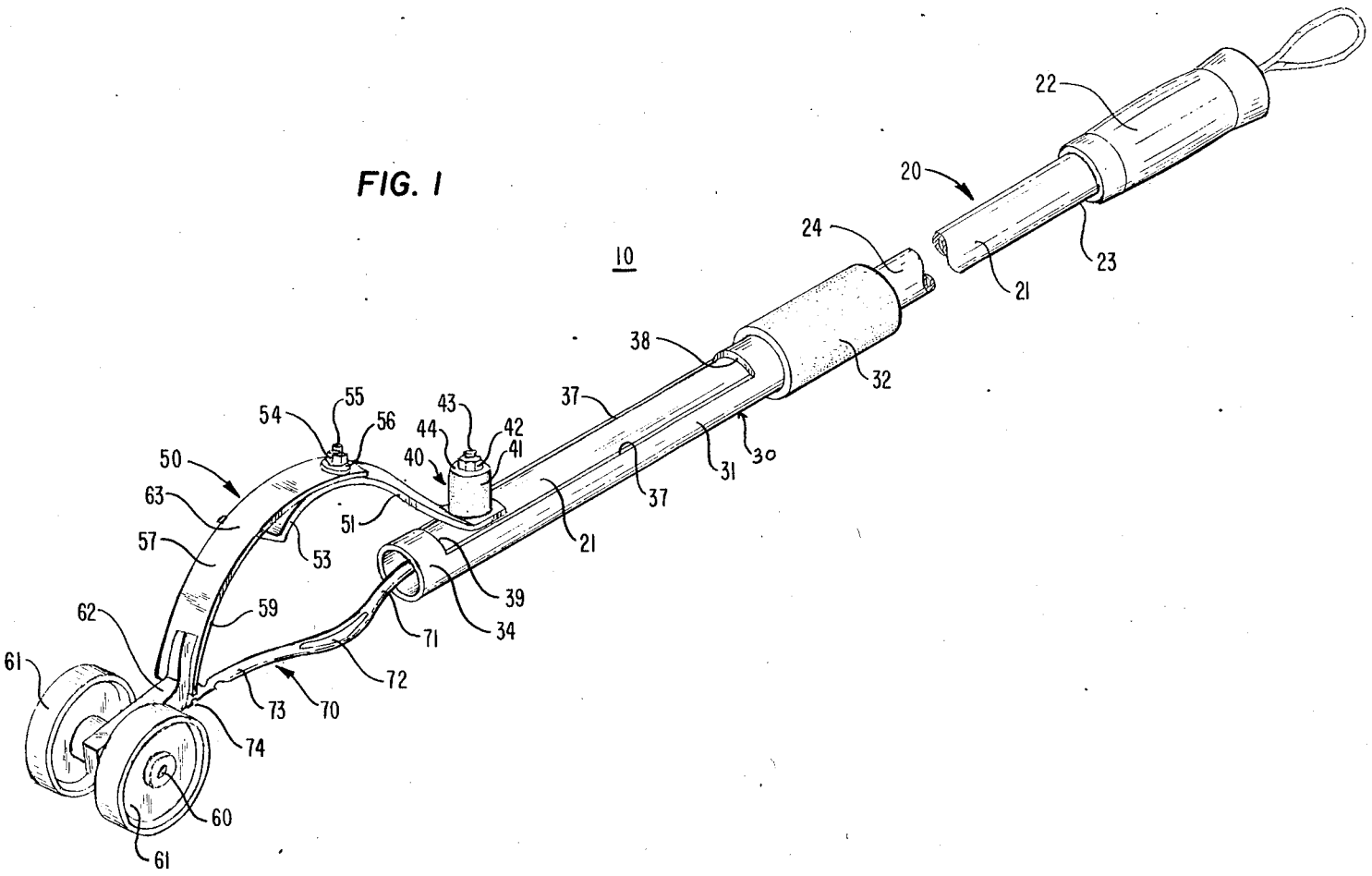
FIG. 1 is a perspective view of the refuse collection device of the present invention in the first configuration.

FIG. 1 is a perspective view of refuse collection device 10 of the rpesent invention in the first configuration generally comprising: cylindrical elongated tubular structure 20; longitudinally slidable structure 30; transverse support structure 40; divided semi-circular spring structure 50; and pointed rod structure 70. Structure 20 further comprises: tubular member 21 including proximal end 23 and distal end 24; and handle member 22 being attached to proximal end 23. In this first configuration, structure 30 is its most proximal position; structure 50 is in its most distal position being distal to structure 40 and being in line with the longitudinal axis of structure 20; and rod structure 70 is fully exposed.

Figure 2:
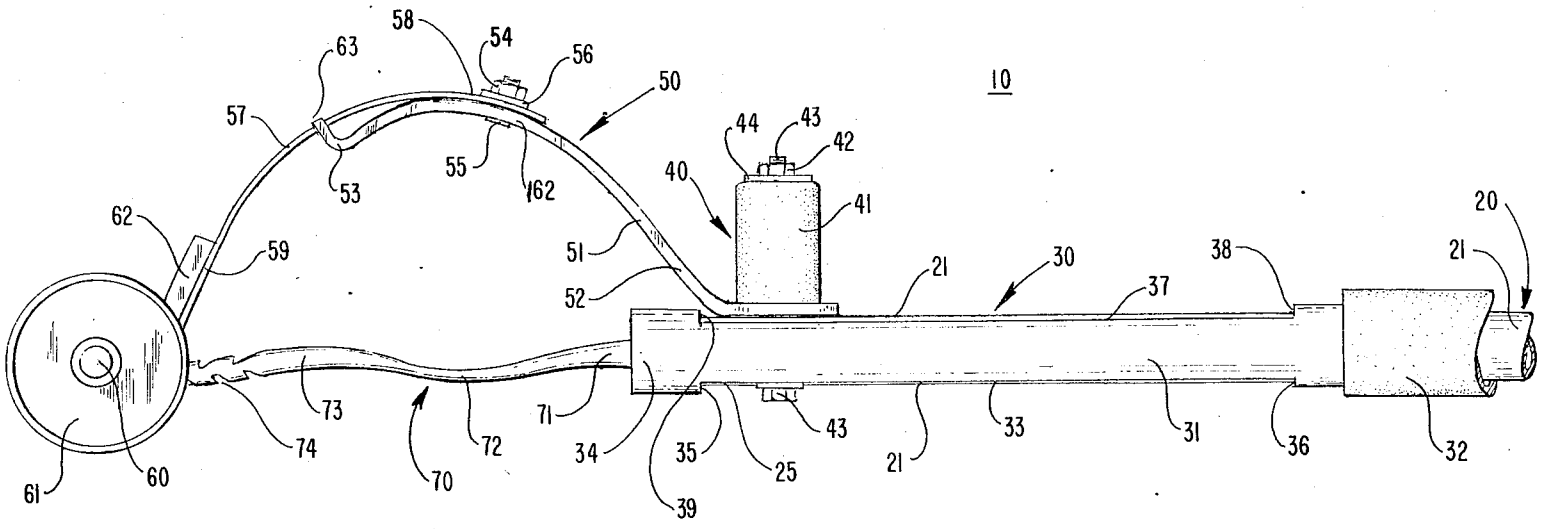
FIG. 2 is a side view of the distal end of the refuse collection device in the first configuration.

FIG. 2 is a side view of the distal end of refuse collection device 10 in the first configuration showing: structure 20 including member 21; structure 30 in its most proximal position; structure 40; structure 50 in its most distal position; and structure 70 being exposed. Structure 30 further comprises: proximal cylindrical handle member 32 being longitudinally slidable along member 21; lateral partially cylindrical member 31 being fixedly attached to member 32 and also being longitudinally slidable along member 21; a top slit or groove or cutout of member 31 being defined by proximal edge 38, lateral edge 37, and distal edge 39; a bottom slit or groove or cutout of member 31 being defined by proximal edge 36, lateral edge 33, and distal edge 35; and distal cylindrical member 34 being fixedly attached to member 31 and also being longitudinally slidable along member 21. Structure 40 further comprises: screw 43; nut 42 being removably attached to screw 43; washer 44; and enclosure structure 41 for including spring 45, not shown herein. Spring 45 provides: compression between screw 43 and most distal end 25 of member 21; compression between nut 42 and washer 44; compression between washer 44 and enclosure structure 41; compression between enclosure 41 and proximal end 52 of member 51; compression between proximal end 52 of member 51 and most distal end 25 of member 21; and tension to screw 43. Structure 40 fixedly attaches pointed rod 70 at its proximal end 71 to most distal end 25 of member 21 and allows two planar rotation of member 51 about screw 43. Structure 50 comprises: proximal quarter-circular subtstantially rigid member 51 having its proximal end 52 being movably attached to most distal end 25 of member 21 by structure 40 and including middle portion 162 being rotatably attached to proximal end 58 of member 57; distal quarter-circular spring member 57 including proximal end 58 being rotatably attached to middle portion 162 of member 51, including middle portion 63 being supported unidirectionally by distal end 53 of member 51, and including wheel member 61 being rotatably attached to distal end 59 thereof at transverse axis member 60 via connecting member 62; and screw 55, nut 54, and washer 56 for rotatably attaching middle portion 162 of member 51 and proximal portion 58 of member 57. Rod structure 70 comprises: pointed free distal end 73 including serrations 74; proximal end 71 being fixedly attached to most distal end 25 of member 21 by structure 40; and concave middle portion 72.

Figure 3:
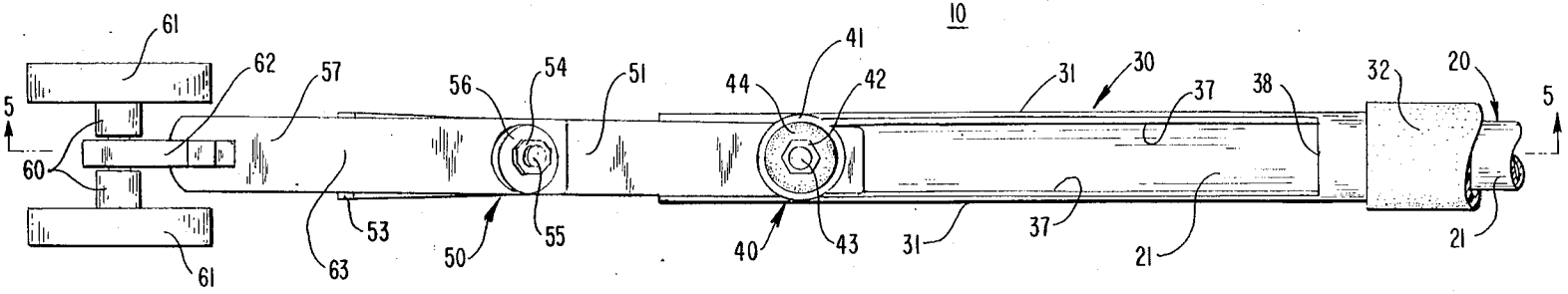
FIG. 3 is a top view of the distal end of the refuse collection device in the first configuration.

FIG. 3 is a top view of the distal end of refuse collection device 10 in the first configuration showing; structure 20 including member 21; structure 30 including lateral members 31, handle portion 32, proximal edge 38, and lateral edges 37; structure 40 including screw 43, nut 42, washer 44, and enclosure member 41; and structure 50 including member 51 with distal end 53, screw 55, nut 54, washer 56, member 57 with middle portion 63, wheel members 61, axis member 60, and connecting member 62.

Figure 4:
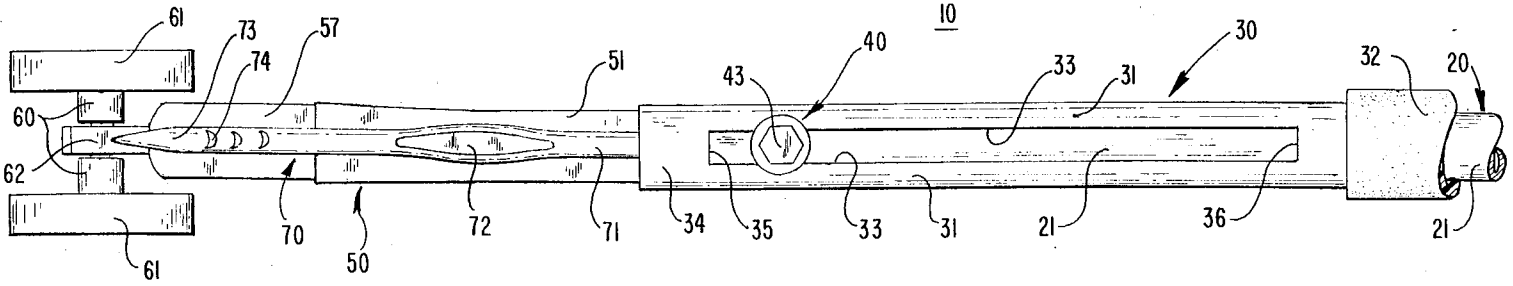
FIG. 4 is a bottom view of the distal end of the refuse collection device in the first configuration.

FIG. 4 is a bottom view of the distal end of refuse collection device 10 in the first configuration showing: structure 20 including member 21; structure 30 including handle member 32, lateral members 31, proximal edge 36, lateral edges 33, distal edge 35, and distal member 34; structure 50 including member 51, member 57, wheel members 61, axis member 60, and connecting member 62; structure 40 including screw 43; and rod structure 70 including proximal end 71, concave portion 72, and distal end 73 with serrations 74.

Figure 5:
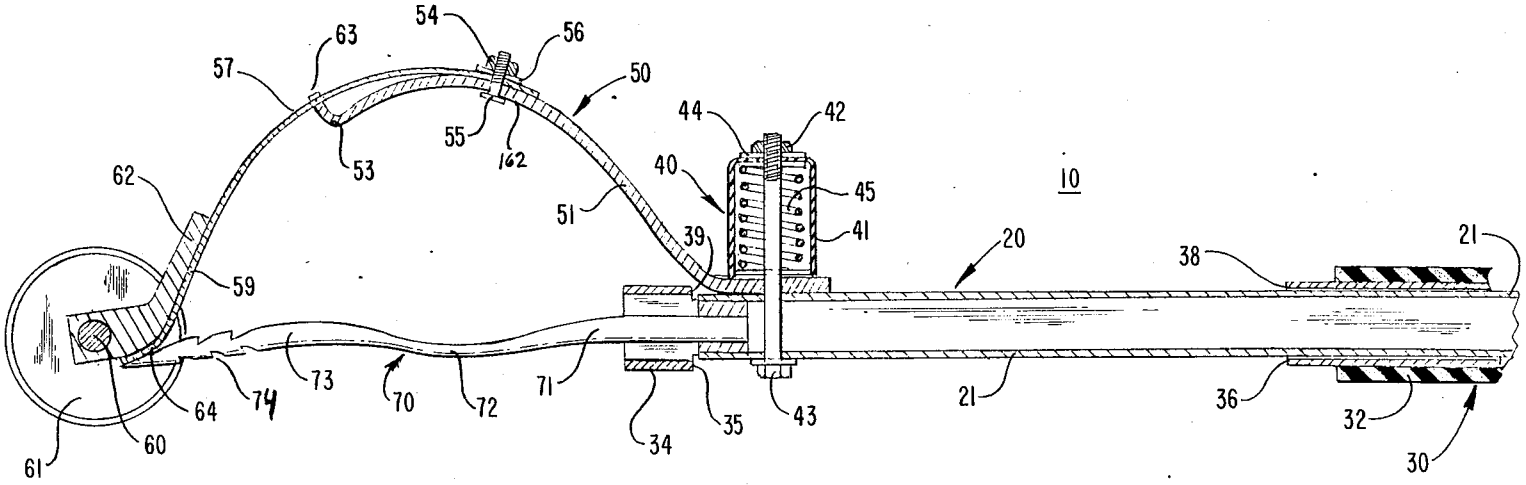
FIG. 5 is a partially cross-sectional side view of the distal end of the refuse collection device in the first configuration.

FIG. 5 is a partially cross-sectional side view of the distal end of refuse collection device 10 along line 5—5 of FIG. 3 in the first configuration showing: structure 20 including member 21; structure 30 including handle member 32, proximal edge 36, proximal edge 38, distal edge 35, distal edge 39, and distal member 34; structure 50 including member 51 with distal end 53, member 57 with middle portion 63 and distal end 59, wheel member 61, screw 55, nut 54, washer 56, axis member 60, and connecting member 62; structure 40 including screw 43, washer 44, spring 45, enclosure member 41, and nut 42; and rod structure 70 including proximal end 71, concave portion 72, and distal end 73 with serrations 74.

Figure 6:
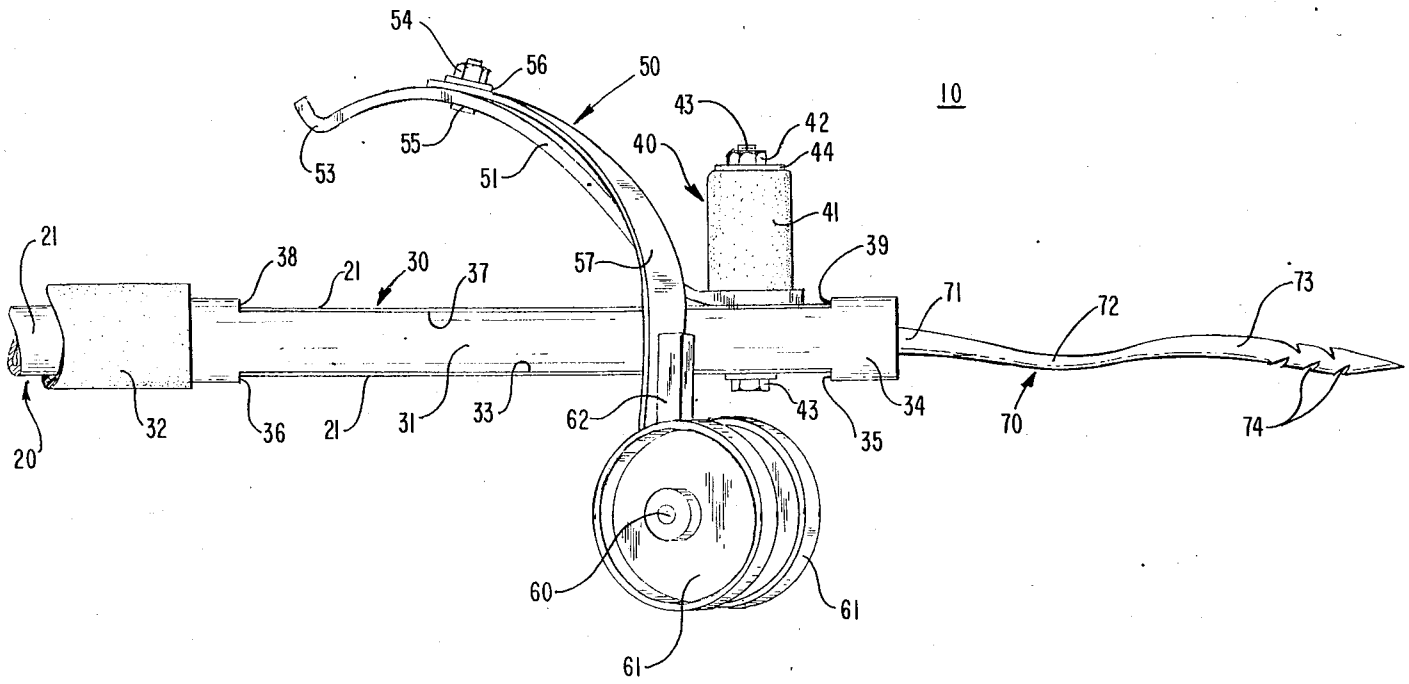
FIG. 6 is a side view of the distal end of the refuse collection device in the second configuration.

FIG. 6 is a side view of the distal end of refuse collection device 10 in the second configuration showing: structure 20 including member 21; structure 30 including handle member 32, lateral member 31, proximal edge 36, proximal edge 38, distal edge 35, distal edge 39, lateral edge 33, lateral edge 37, and distal member 34; structure 50 including member 51 with free distal end 53, member 57, wheel members 61, connecting member 62, axis member 60, screw 55, washer 56, and nut 54; structure 40 including screw 43, washer 44, enclosure member 41, and nut 42; and rod structure 70 including proximal end 71, concave portion 72, and distal end 73 with serrations 74. In this second configuration, structure 30 is in its most proximal position, rod structure 70 is fully exposed proximal rigid member 51 is rotated rearwardly relative to support structure 40 and is located at an acute angle relative to the longitudinal axis of tubular structure 20, distal spring member 57 is rotated forwardly relative to proximal rigid member 51 and is located at an acute angle relative to proximal rigid member 51 whereby wheel members 61 are located substantially laterally to support structure 40.

Figure 7:
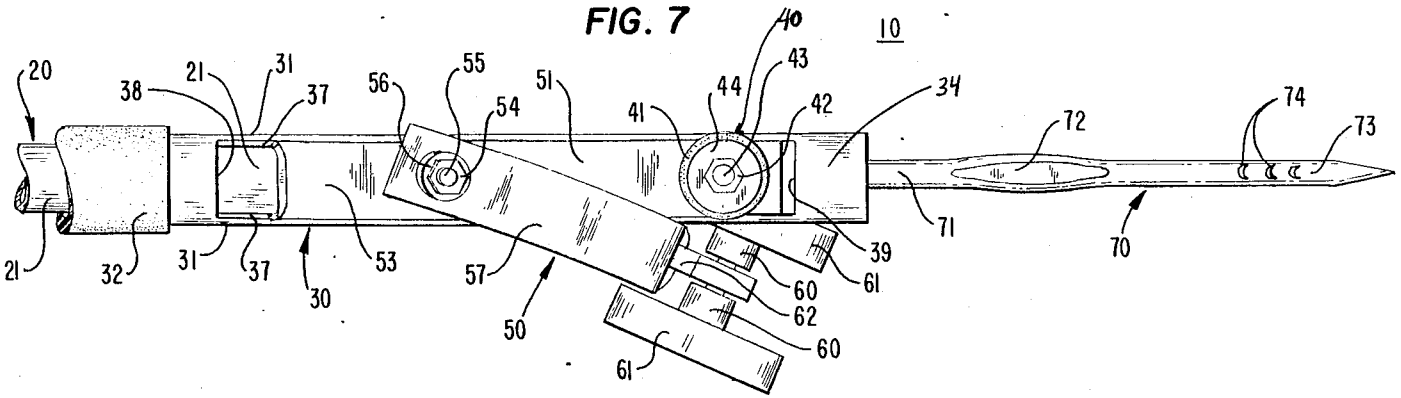
FIG. 7 is a top view of the distal end of the refuse collection device in the second configuration.

FIG. 7 is a top view of the distal end of refuse collection device 10 in the second configuration showing: structure 20 including member 21; structure 30 including handle portion 32, distal member 34, lateral members 31, proximal edge 38, distal edge 39, and lateral edges 37; structure 40 including screw 43, washer 44, nut 42, and enclosure member 41; structure 50 including member 51 with free distal end 53, screw 55, washer 56, nut 54, member 57, wheel members 61, axis member 60, and connecting member 62; and rod structure 70 including proximal end 71, concave portion 72, and distal end 73 with serrations 74.

Figure 8:
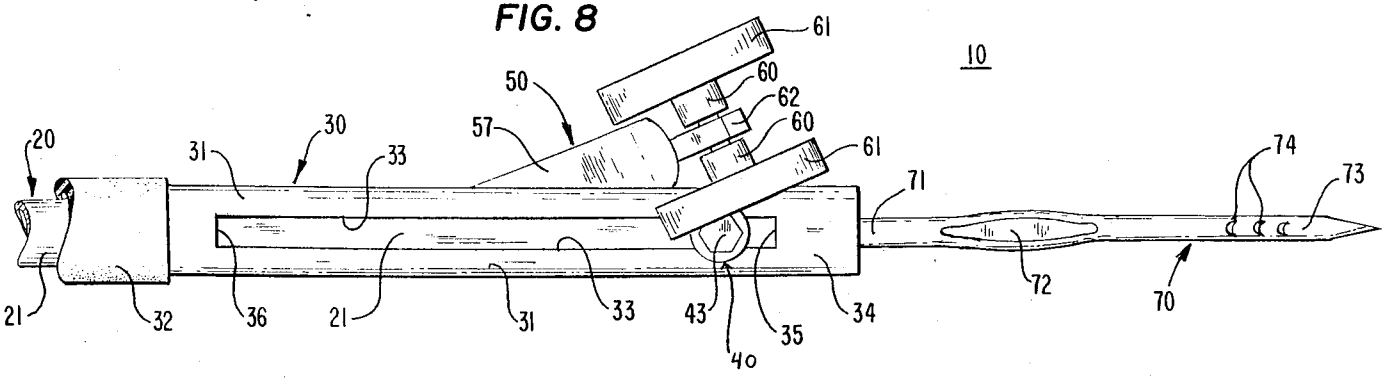
FIG. 8 is a bottom view of the distal end of the refuse collection device in the second configuration.

FIG. 8 is a bottom view of the distal end of refuse collection device 10 in the second configuration showing: structure 20 including member 21; structure 30 including handle member 32, lateral members 31, proximal edge 36, lateral edges 33, distal edge 35, and distal member 34; structure 50 including wheel members 61, connecting member 62, axis member 60, and distal member 57; structure 40 including screw 43; and rod structure 70 including proximal end 71, curved portion 72, and distal end 73 with serrations 74.

Figure 9:
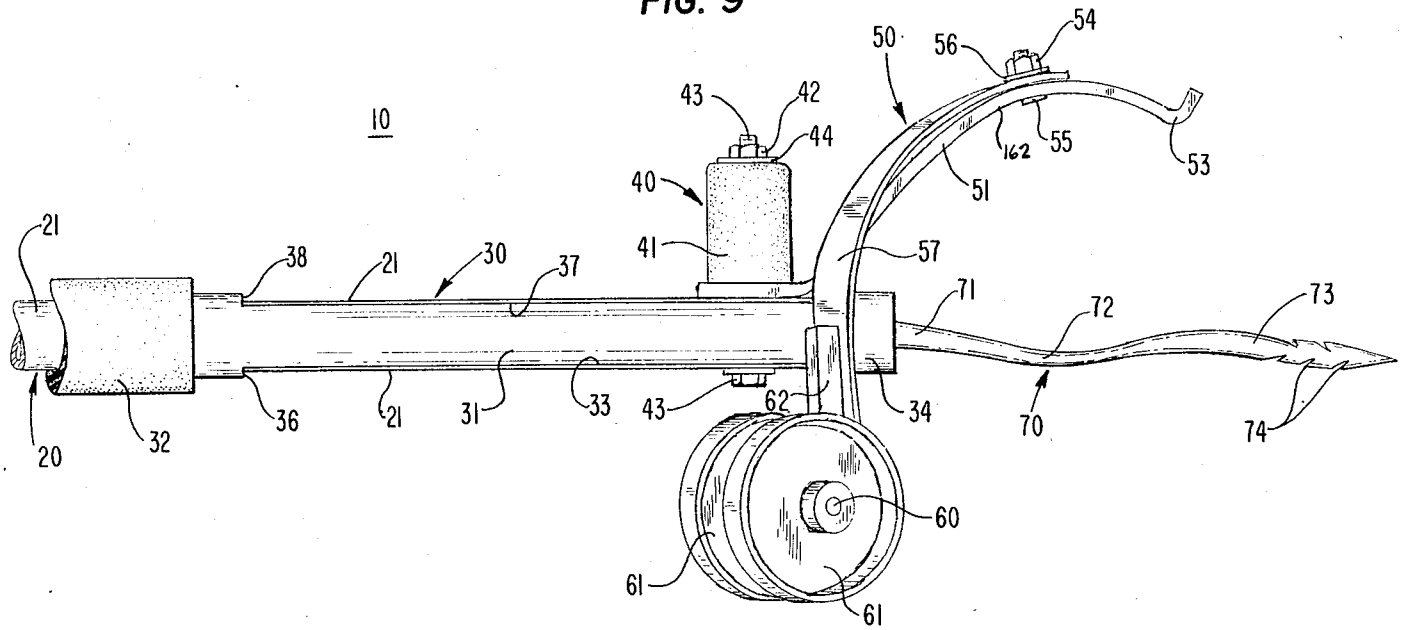
FIG. 9 is a side view of the distal end of the refuse collection device in the third configuration.

FIG. 9 is a side view of the distal end of refuse collection device 10 in the third configuration showing: structure 20 including member 21: structure 30 including handle member 32, lateral member 31, proximal edge 36, proximal edge 38, lateral edge 33, lateral edge 37, and distal member 34; structure 50 including member 51 with free distal end 53, member 57, connecting member 62, wheel members 61, axis member 60, screw 55, washer 56, and nut 54; structure 40 including screw 43, washer 44, enclosure member 41, and nut 42; and rod structure 70 including proximal end 71, concave portion 72, and distal end 73 with serrations 74. In this third configuration, structure 30 is in its most proximal position, rod structure 70 is fully exposed, proximal rigid member 51 is in its most distal position and is line with the longitudinal axis of tubular structure 20, distal spring member 57 is rotated rearwardly relative to proximal rigid member 51 and is located at an acute angle relative to proximal rigid member 51 whereby wheel members 61 are located substantially laterally to support structure 40.

Figure 10:
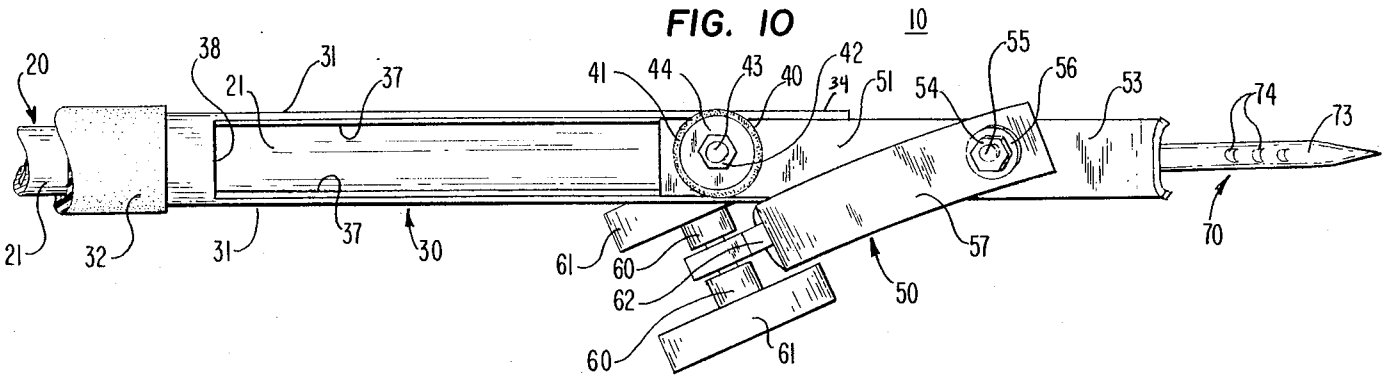
FIG. 10 is a top view of the distal end of the refuse collection device in the third configuration.

FIG. 10 is a top view of the distal end of refuse collection device 10 in the third configuration showing: structure 20 including member 21; structure 30 including handle portion 32, lateral members 31, member 34, proximal edge 38, and lateral edges 37; structure 40 including screw 43, washer 44, nut 42, and enclosure member 41; structure 50 including member 51 with free distal end 53, screw 55, washer 56, nut 54, member 57, wheel members 61, axis member 60, and connecting member 62; and rod structure 70 including distal end 73 with serrations 74.

Figure 11:
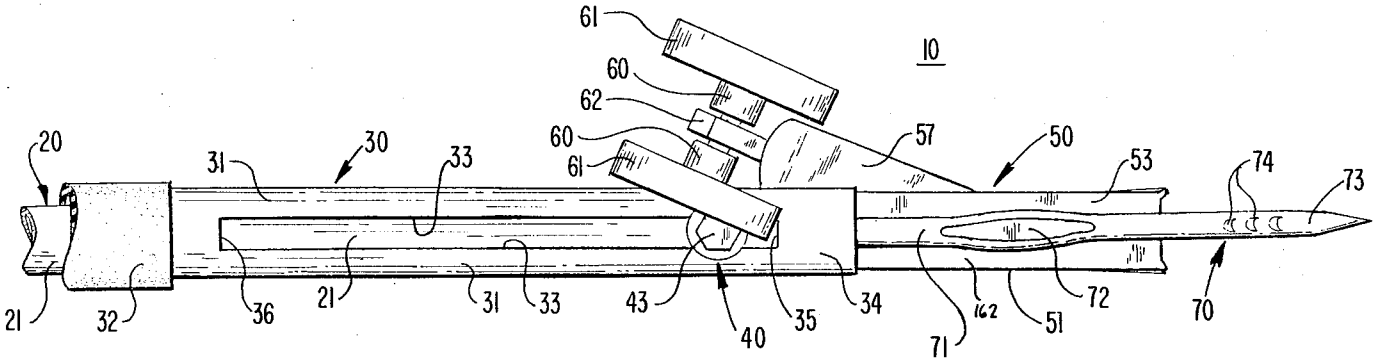
FIG. 11 is a bottom view of the distal end of the refuse collection device in the third configuration.

FIG. 11 is a bottom view of the distal end of refuse collection device 10 in the third configuration showing: structure 20 including member 21; structure 30 including handle member 32, lateral members 31, proximal edge 36, lateral edges 33, distal edge 35, and distal member 34; structure 50 including wheel members 61, connecting member 62, axis member 60, proximal member 51 with free distal end 53, and distal member 57; structure 40 including screw 43; and rod structure 70 including proximal end 71, curved portion 72, and distal end 73 with serrations 74.

The use of device 10 is as follows:

a. for picking up paper, bags, cardboard, and other flat objects on hard surfaces such as a rug or a driveway, device 10 is used in its first configuration such that the operator places wheel members 61 on the surface in front of the object to be picked up, the operator then applies a rearward or counterclockwise torque to structure 20 to cause exposed distal end 73 of rod structure 70 to separate rearwardly from distal end 59 of member 57, and then the operator allows such separated structures to approach each other and pinch or clamp the object at location 64 of FIG. 5. The operator then discards the object that was picked up by manually separating rod structure 70 from members 57 thereby loosening the grip on the object;

b. For picking up paper, bags, cardboard, and other penetratable objects on soft surfaces such as dirt or sand, device 10 is used in its second configuration such that the operator merely spears the object to be picked up with distal end 73 of rod structure 70 and discards of same manually. Serrations 74 of distal end 73 retain the object that was picked up on rod structure 70 until such object is manually discarded by the operator. Structure 30 may be slid forwardly along structure 20 and past structure 50 to forceably displace the object that was picked up from rod structure 70; and c. for picking up bottles, cans, and other circular or cylindrical objects on almost any surface, device 10 is used in its third configuration such that the operator uses device 10 upside down by placing free distal end 53 of member 51 under the object to be picked up and places concave portion 72 of rod structure 70 above the object, and then the operator pushes forwardly upon structure 20 to cause middle portion 162 of member 51 to snap onto and surround the object. The operator then discards the object that was picked up by manually separating member 51 from rod structure 70 to thereby release the object.

For transporting and storing device 10, it is recommended that structure 30 be in its most distal position regardless of the position of structure 50 or the configuration of device 10 so that pointed rod structure 70 may be fully covered.

While the arrangement according to the present invention has been described in terms of a specific illustrative embodiment, it will be apparent to those skilled in the art that many modifications are possible within the spirit and scope of the disclosed principle.

What is claimed is:

1. A refuse collection device comprising: a cylindrical elongated tubular structure including a proximal handle end and a distal functional end; a transverse support structure penetrating said elongated tubular structure distal functional end for fixedly supporting a further distal pointed rod structure and for rotatably supporting a further distal divided semi-circular spring structure; and a slidable structure being longitudinally slidable on said elongated tubular structure and including top and bottom longitudinally directed grooves or slits for accommodating said transverse support structure during the longitudinal motion of said slidable structure; said semi-circular spring structure including a proximal quarter-circular substantially rigid member having its proximal end being rotatably attached to said transverse support structure, a distal quarter-circular spring member having its proximal end being rotatably attached to said proximal quarter-circular substantially rigid member distal end, and transverse wheel members being rotatably attached to said distal quarter-circular spring member distal end.

2. The refuse collection device of claim 1 wherein in a first configuration: said semi-circular spring structure is in line with said elongated tubular structure longitudinal axis and distal to said transverse support structure; and said slidable structure is in its most proximal position along said elongated tubular structure thereby exposing said proximal rod structure, so that the refuse collection device may be used for picking up paper, bags, cardboard, and other flat debris on hard surfaces.

3. The refuse collection device of claim 1 wherein in a second configuration: said proximal quarter-circular substantially rigid member is rotated rearwardly relative to said transverse support structure and is located at an acute angle relative to said elongated tubular structure longitudinal axis; said distal quarter-circular spring member is rotated forwardly relative to said proximal quarter-circular substantially rigid member and is located at an acute angle relative to said proximal quarter-circular substantially rigid member; said wheel members are located substantially laterally to said transverse support structure; and said slidable structure is in its most proximal position along said elongated tubular structure thereby exposing said pointed rod structure, so that the refuse collection device may be used for picking up paper, bags, cardboard, and other penetrable debris on soft surfaces.

4. The refuse collection device of claim 1 wherein in a third configuration: said proximal quarter-circular substantially rigid member is in line with aidh elongated tubular structure longitudinal axis and distal to said transverse support structure; said distal quarter-circular spring member is rotated rearwardly relative to said proximal quarter-circular substantially rigid member and is located at an acute angle relative to said proximal quarter-circular substantially rigid member; said wheel members are located substantially laterally to said transverse support structure; and said slidable member is in its most proximal position along said elongated tubular structure thereby exposing said pointed rod structure, so that the refuse collection device may be used for picking up bottles, cans, and other circular or cylindrical debris on almost any type surface.

* * * * *